US011627411B2

(12) United States Patent
Bouchet

(10) Patent No.: US 11,627,411 B2
(45) Date of Patent: Apr. 11, 2023

(54) ENCLOSURE FOR DIFFUSING SOUND BY REVERBERATION

(71) Applicant: FOCAL JMLAB, La Talaudiere (FR)

(72) Inventor: Arnaud Cazes Bouchet, Balbigny (FR)

(73) Assignee: FOCAL JMLAB, La Talaudiere (FR)

( * ) Notice: Subject to any disclaimer, the term of this patent is extended or adjusted under 35 U.S.C. 154(b) by 0 days.

(21) Appl. No.: 17/787,374

(22) PCT Filed: Dec. 21, 2020

(86) PCT No.: PCT/HR2020/052576

§ 371 (c)(1),
(2) Date: Jun. 20, 2022

(87) PCT Pub. No.: WO2021/130441

PCT Pub. Date: Jul. 1, 2021

(65) Prior Publication Data

US 2023/0044069 A1 Feb. 9, 2023

(30) Foreign Application Priority Data

Dec. 24, 2019 (FR) ..... 1915555

(51) Int. Cl.
*H04R 1/34* (2006.01)
*H04R 1/02* (2006.01)
(Continued)

(52) U.S. Cl.
CPC ..... *H04R 1/345* (2013.01); *H04R 1/025* (2013.01); *H04R 1/30* (2013.01); *H04R 1/34* (2013.01);
(Continued)

(58) Field of Classification Search
CPC . H04R 1/025; H04R 1/26; H04R 1/30; H04R 1/323; H04R 1/34; H04R 1/345;
(Continued)

(56) References Cited

U.S. PATENT DOCUMENTS 6,343,133 B1 * 1/2002 Adamson ..... H04R 1/26 381/337
7,802,650 B2 * 9/2010 Bartlett ..... H04R 1/30 381/342
(Continued)

FOREIGN PATENT DOCUMENTS

IT RM 2012 A 000086 9/2013
IT RM20120086 A1 9/2013

OTHER PUBLICATIONS

Poletti, M., et al., "Sound-field reproduction systems using fixed-directivity loudspeakers", J. Accoust. Soc. Am. vol. 127, 3590-3601 (2010).
(Continued)

*Primary Examiner* — Huyen D Le
(74) *Attorney, Agent, or Firm* — Harris Beach PLLC

(57) ABSTRACT

AMENDMENT TO THE ABSTRACT
The invention relates to an enclosure for diffusing sound by reverberation comprising:—a loudspeaker comprising a fixed frame, a cylindrical support and a membrane connected to an upper bearing surface of the frame; and—a wave guide mounted on the upper bearing surface, the wave guide being substantially in the form of a truncated pyramid with a long wall forming a front face, a short wall and lateral uprights; the wave guide comprising at least one acoustic wall fastened to the lateral uprights, the acoustic wall extending tangentially relative to the generatrix line of the cylindrical support closest to the front face.

9 Claims, 9 Drawing Sheets

(51) Int. Cl.
*H04R 7/18* (2006.01)
*H04R 7/12* (2006.01)
*H04R 1/30* (2006.01)

(52) U.S. Cl.
CPC ..... *H04R 7/127* (2013.01); *H04R 7/18* (2013.01); *H04R 2201/34* (2013.01); *H04R 2400/11* (2013.01); *H04R 2400/13* (2013.01)

(58) Field of Classification Search
CPC ..... H04R 7/18; H04R 7/127; H04R 2201/34; H04R 2400/11; H04R 2400/13
See application file for complete search history.

(56) References Cited

U.S. PATENT DOCUMENTS

| | | | | |
|---|---|---|---|---|
| 2016/0119711 | A1 | 4/2016 | DeLay et al. | |
| 2017/0026750 | A1 | 1/2017 | Mansfield et al. | |
| 2017/0325019 | A1 | 11/2017 | Bezzola et al. | |
| 2022/0353607 | A1* | 11/2022 | Garcia ..... | H04R 1/30 |

OTHER PUBLICATIONS

ISA/EPO International Search Report and Written Opinion for corresponding International Application No. PCT/FR2020/052576 dated Dec. 21, 2020 (9 pages).
ISA/EPO International Search Report and Written Opinion for corresponding International Application No. PCT/FR2020/052576 dated Dec. 21, 2020 (9 pages). English translation from espacenet.com including Figures 1-7 from the priority document.

* cited by examiner

ENCLOSURE FOR DIFFUSING SOUND BY REVERBERATION

CROSS-REFERENCE TO RELATED APPLICATIONS

This application is a national stage application under 35. U.S.C. § 371 of PCT Application No PCT/FR2020/052576, filed on Dec. 21, 2020, which claims priority to, and the benefit of French Application No. 1915555 filed on Dec. 24, 2019, which are incorporated herein by reference in their entirety.

TECHNICAL FIELD

The invention relates to an enclosure for diffusing sound by reverberation, i.e., an enclosure intended to project sound waves onto a reflective surface, typically a ceiling or a wall of a room.

The invention relates more particularly to an enclosure in which the crosstalk is high between the sound waves obtained by reverberation and those projected in front of the enclosure.

The invention finds a particularly advantageous application for home cinema installations, movie theaters, or music listening rooms where it is sought to spatialize sound waves.

PRIOR ART

To spatialize sound waves in a room, it is known to integrate several enclosures at different locations in the room in order to provide the audience with sounds coming from several directions. This solution is used, in particular, to improve immersion in a movie or improve the listening quality of a piece of music.

The scientific publication "Poletti et al.: Sound reproduction with fixed-directivity enclosures; J. Acoust. Soc. Am., Vol. 127, No. 6, June 2010" describes the layout constraints to form correctly spatialized sound waves in a room according to the position of the audience. As indicated in this publication, a major obstacle to the generalization of this technology lies in the complexity of integrating the enclosures necessary to form the spatialized sound waves. For example, it is often complex for an individual wishing to create a home cinema to integrate enclosures in a ceiling or in a wall.

To address this problem, enclosures currently on the market make it possible to project sound waves onto a reflective surface, typically a ceiling or a wall of a room, acting as an acoustic mirror.

This solution makes it possible to simulate the positioning of an enclosure on a wall or a ceiling. Thus, instead of receiving the sound waves coming directly from an enclosure facing the audience, the audience can also receive one or more sound waves obtained by reverberation on a reflective surface by means of an enclosure distant from this reflective surface.

In the example of FIG. 1, an enclosure 100 for diffusing sound by reverberation is placed on the floor 40 in front of a screen (not shown) of a home cinema room. The enclosure 100 comprises a loudspeaker 110 oriented towards the ceiling 41 so as to transmit the sound waves by reverberation on the ceiling 41 of the home cinema room.

However, this type of enclosure poses a crosstalk problem. Within the meaning of the invention, the crosstalk corresponds to the ratio between the sound Sr picked up by the audience by reverberation and the sound Sd picked up directly from the enclosure. For example, this crosstalk can be measured by a microphone 42, as shown in FIG. 1.

Obviously, the propagation time of the sound waves obtained by reverberation is greater than the propagation time of the sound waves transmitted directly from the loudspeaker of the enclosure. Therefore, the presence of directly transmitted sound waves disturbs the listening quality of the sound waves obtained by reverberation and it is sought to limit the direct transmission of sound to improve crosstalk.

In addition, the acoustic energy radiated by the loudspeaker weakens proportionally to the square of the distance traveled. Thus, using a loudspeaker operating by reverberation, the loudspeaker must provide a much greater acoustic energy than that used to obtain direct propagation.

To meet these requirements, it is possible to use a loudspeaker with a large diameter, i.e., with a diameter greater than 20 cm.

However, with this type of loudspeaker, it is not possible to obtain a low-profile enclosure, i.e., less than 14 cm high by 28 cm long and 18 cm wide.

To obtain a low-profile enclosure, it is necessary to use a smaller loudspeaker. However, loudspeakers of smaller dimensions are less directive and pose problems of diffraction and acoustic break-up, which degrade acoustic performance.

To partially remedy these problems, it is possible to use a wave guide 120 on the loudspeaker 110 in order to limit the propagation of the sounds Sd, as shown in FIG. 1. However, even with a wave guide 120, it is necessary to limit the angle of inclination a between the loudspeaker and the length of the box of the enclosure in order to obtain an acceptable level of crosstalk with a low-profile loudspeaker. Typically, the angle of inclination a1 of a low-profile enclosure is close to 70° , which limits the possible distance between the loudspeaker 100 and the audience. Thus, a low-profile enclosure is conventionally placed less than 2 m from the audience so that the sound waves obtained by reverberation on a ceiling reach the audience correctly.

The same issues arise for an enclosure for diffusing sound by reverberation configured to project sound waves onto a wall in a room.

Thus, the technical problem of the invention is to find how to improve the crosstalk of an enclosure for diffusing sound by reverberation, in particular for low-profile enclosures.

DISCLOSURE OF THE INVENTION

To address this problem, the invention proposes using at least one acoustic wall integrated into the wave guide in order to improve the performance of the wave guide.

The invention is the result of a discovery resulting from the observation that the highest frequencies are not correctly picked up by the wave guide in the context of an enclosure for diffusing sound by reverberation.

To remedy this problem, the invention required extensive studies to determine how to modify the directivity of the high frequencies generated by the loudspeaker of an enclosure for diffusing sound by reverberation. In particular, acoustic walls of very different shapes and positions were tested. It emerges from these studies that the crosstalk is improved in a very surprising manner when at least one acoustic wall is fastened onto the lateral uprights of the wave guide, and when this acoustic wall extends tangentially relative to the generatrix line of the cylindrical support of the loudspeaker closest to a front face of the enclosure.

To this end, according to a first aspect, the invention relates to an enclosure for diffusing sound by reverberation comprising:

a loudspeaker comprising:

a fixed frame, a cylindrical support movable in translation, and a membrane whose annular outer edge is connected to an upper bearing surface of said frame by means of a suspension, and an annular inner edge which is fastened onto said cylindrical support; and a wave guide mounted on said upper bearing surface of said frame, said wave guide being substantially in the shape of a truncated pyramid with a long wall, a short wall and lateral uprights connecting said walls;

wherein said long wall forms a front face of said enclosure such that said long wall blocks the propagation of sound in front of said enclosure so that the greater part of the sound is directed towards a reflective surface.

The invention is characterized in that said wave guide also comprises at least one acoustic wall fastened onto said lateral uprights, said acoustic wall extending tangentially relative to the generatrix line of said cylindrical support closest to said front face.

The modification carried out on the wave guide makes it possible to improve the crosstalk of an enclosure for diffusing sound by reverberation by channeling the high frequencies generated by the enclosure.

This improvement in crosstalk makes it possible to use loudspeakers with smaller diameters, typically diameters between 5 and 15 cm, so as to obtain an enclosure with reduced dimensions. For example, the enclosure may be made in a box onto which said loudspeaker and said wave guide are fastened, said cabinet being less than 14 cm high, less than 28 cm long and less than 18 cm wide.

These reduced dimensions make it possible to meet the space constraints of individuals.

Improved crosstalk also makes it possible to reduce the angle of inclination of the loudspeaker relative to the length of the box. Thus, it is now possible to incline the loudspeaker at an angle of between 30 and 50° relative to the height of the box.

According to the invention, the inclination of the loudspeaker relative to the length of the box means that the axis of the loudspeaker passing through the center of the cylindrical support is offset relative to an axis extending along the length of the box, for example an axis directed towards a predetermined listening point.

Increasing the angle of inclination of the loudspeaker makes it possible to increase the distance between the enclosure and the audience. Indeed, while a low-profile enclosure is necessarily placed less than 2 m from the audience so that the sound waves obtained by reverberation on a ceiling reach the audience correctly, the invention makes it possible to place the enclosure at a distance between 3 and 4.5 m. As a result, the enclosure can be further from the audience, which also limits layout constraints. The same principle applies for an enclosure projecting sound onto a wall.

To achieve the power performance required to maintain an acceptable sound level at this distance, the upper surface of the cylindrical support is preferably provided with a dome, for example an inverted dome.

Within the meaning of the invention, an inverted dome consists of a dome whose curvature is oriented towards an inner part of the fixed frame.

However, increasing the power of a low-profile enclosure will increase the problems of diffraction and acoustic breakup. To solve these problems, it is possible to further limit crosstalk by using a second acoustic wall.

According to one embodiment, said wave guide also comprises a second acoustic wall, fastened between said lateral uprights and between said first acoustic wall extending tangentially relative to the generatrix line and said front face, said second acoustic wall extending substantially parallel to said first acoustic wall, a distance between said acoustic walls being substantially equal to the radius of said cylindrical support.

This specific positioning of the second acoustic wall makes it possible to effectively channel the intermediate frequencies between the high frequencies, picked up by the first acoustic wall, and the low frequencies, picked up by the wave guide.

According to one embodiment, said acoustic wall, extending tangentially relative to the generatrix line, comprises a semi-circular lip extending in the direction of said cylindrical support substantially at the center of said lateral uprights.

This embodiment further improves crosstalk by channeling the highest frequencies, generated closest to the loudspeaker, onto the first acoustic wall.

Thus, the invention makes it possible to obtain a low-profile enclosure for diffusing sound by reverberation having significant crosstalk.

According to a second aspect, the invention relates to a home cinema installation integrating an enclosure according to the first aspect of the invention.

BRIEF DESCRIPTION OF THE FIGURES

The way to achieve the invention, as well as the advantages which result therefrom, will clearly emerge from the following embodiments, given by way of indication but not limitation, in support of the appended figures in which:

FIGS. 6*a*-6*f* are cross-sectional views of the loudspeaker and wave guide of FIG. 3 for different frequencies generated by the loudspeaker: 100 Hz (FIG. 6*a*); 1 kHz (FIG. 6*b*); 2 kHz (FIG. 6*c*); 5 kHz (FIG. 6*d*); 10 kHz (FIG. 6*e*) and 16 kHz (FIG. 6*f*).

FIGS. 6*a*-6*f* are cross-sectional views of the loudspeaker and wave guide of FIG. 3 for different frequencies generated by the loudspeaker: 100 Hz (FIG. 6*a*); 1 kHz (FIG. 6*b*); 2 kHz (FIG. 6*c*); 5 kHz (FIG. 6*d*); 10 kHz (FIG. 6*e*) and 16 kHz (FIG. 6*f*).

DETAILED DESCRIPTION OF THE INVENTION

Figure 1:
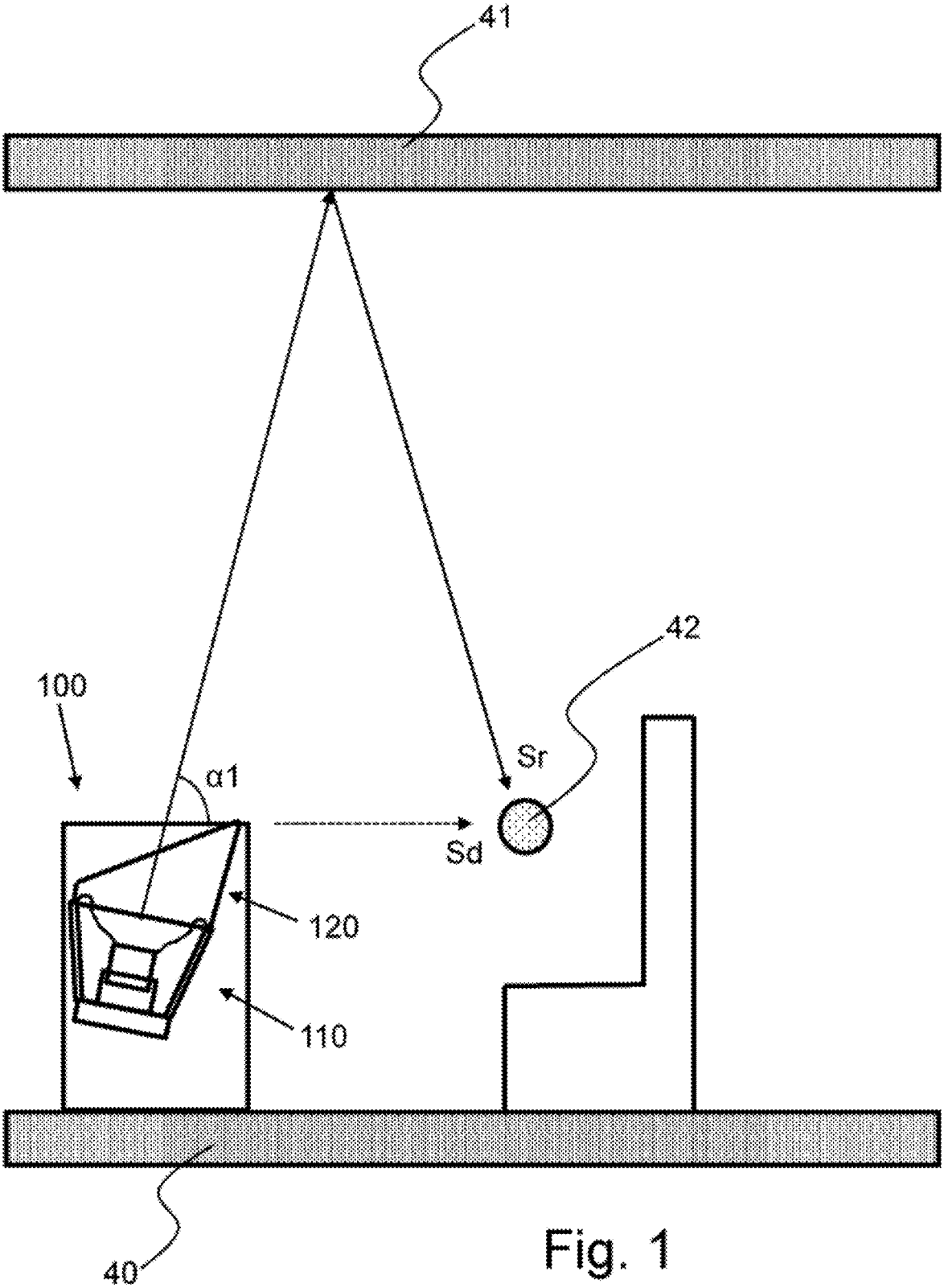
Fig. 1 Prior art
FIG. 1 is a schematic cross-sectional view of a state-of-the-art enclosure for diffusing sound by reverberation used in a home cinema installation.
Figure 2:
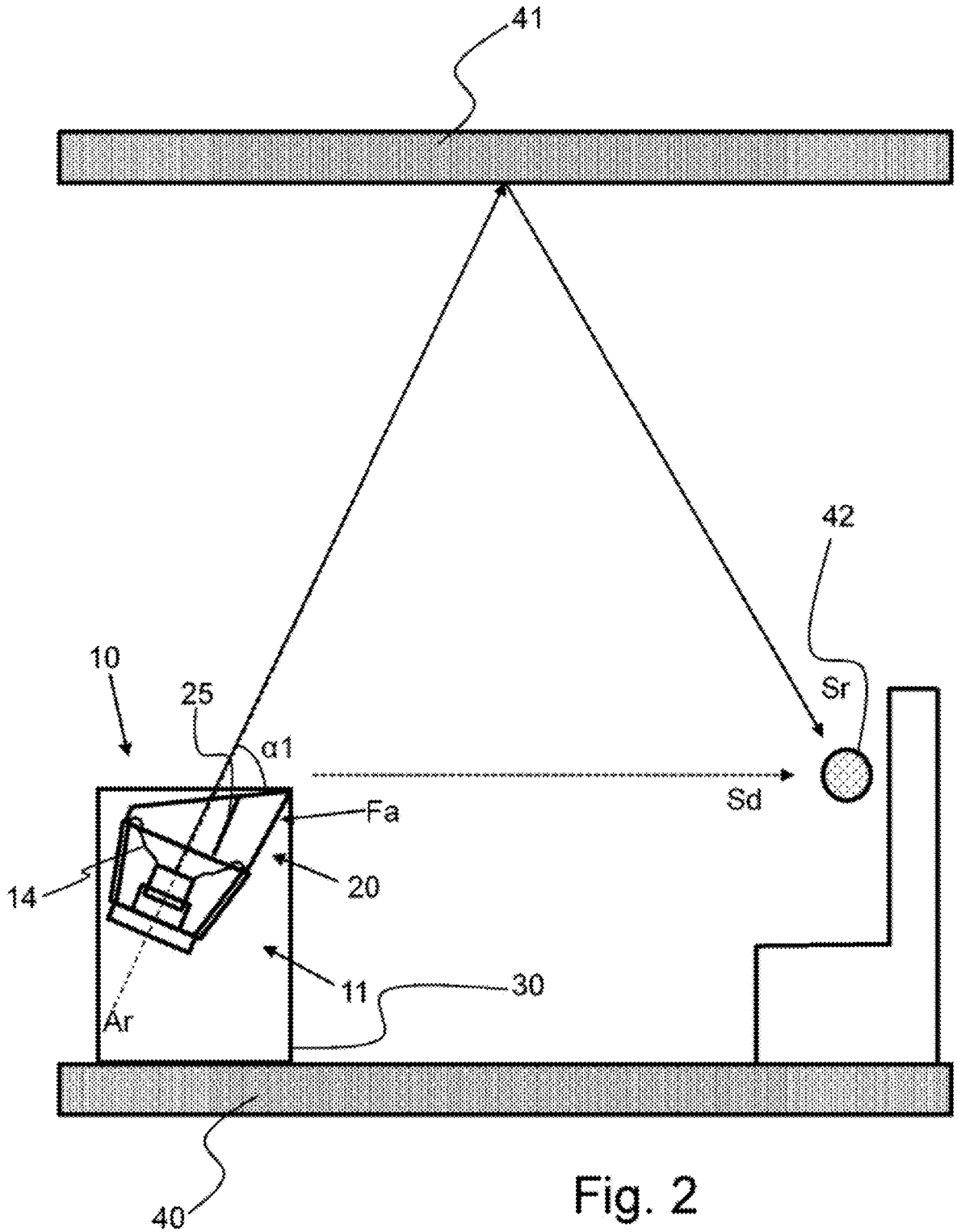
FIG. 2 is a schematic sectional view of an enclosure for diffusing sound by reverberation, according to a first embodiment of the invention, implemented in a home cinema installation.

FIG. 2 illustrates an enclosure 10 for diffusing sound by reverberation, integrated into a home cinema room. To do this, the enclosure 10 is placed on the floor 40 in front of a screen (not shown). The enclosure 10 comprises a loudspeaker 11 oriented towards the ceiling 41 of the cinema room so as to use the ceiling 41 as a reflective surface for the sound waves emitted from the loudspeaker 11. The nature of the reflective surface may vary without changing the invention.

For example, the enclosure 10 may be placed on the ceiling 41 using the floor 40 as a reflective surface, or the enclosure 10 may be turned to a 90° angle to use a wall of the home cinema room as a reflective surface.

The loudspeaker 11 comprises a frame 12, fastened inside a box 30 forming the outer dimensions of the enclosure 10. Preferably, the box 30 is less than 14 cm high, less than 28 cm long, and less than 18 cm wide. Preferably, the power of the loudspeaker 11 is substantially 250 Watts.

The orientation of the loudspeaker 11 relative to the box 30 makes it possible to adjust the angle of inclination a1 and, thus, the distance traveled by the sound waves obtained by reverberation between the enclosure 10 and the audience. In the example of FIG. 2, the angle al between an axis of revolution Ar of the loudspeaker 11 and an axis extending along the length of the box 30 is between 40 and 60° , and preferably between 50 and 52°.

The frame 12 supports a drive motor for a membrane 14. To do this, the loudspeaker 11 comprises a cylindrical support 13, movable in translation by means of the magnetic field generated by the motor (not shown). This cylindrical support 13 is connected to the membrane 14 by an inner annular edge 18 of the membrane 14, fastened onto an upper end of the cylindrical support 13.

Figure 3:
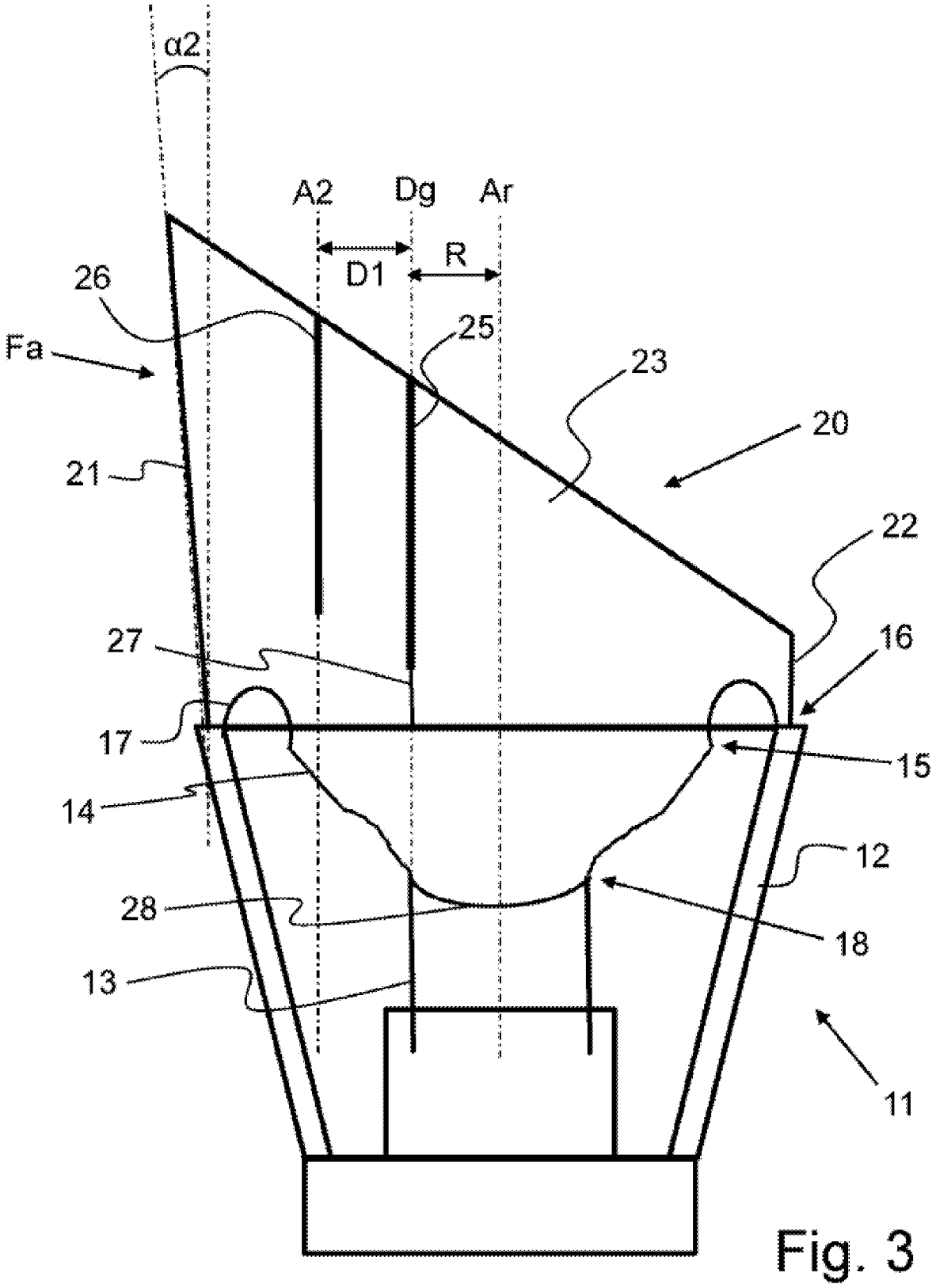
FIG. 3 is a schematic sectional view of a loudspeaker and a wave guide according to a second embodiment of the invention.

In the specification, the relative terms "upper" or "lower" refer to the conventional positioning of a loudspeaker, as illustrated in FIG. 3 in which the motor is arranged in the lower part, while the membrane 14 is arranged in the upper part, of the loudspeaker 11. Obviously, the loudspeaker 11 may be turned without changing the invention.

The outer annular edge 15 of the membrane is itself connected to an upper bearing surface 16 of the frame by means of a suspension 17. Thus, the frame 12 extends from the base of the loudspeaker 11 to its upper end, surrounding the cylindrical support 13 and the membrane 14.

In the lower part of the loudspeaker 11, the cylindrical support 13 preferably has an upper surface 28 provided with a dome, for example an inverted dome. In the upper part of the loudspeaker 11, the upper bearing surface 16 of the frame 12 preferably has a diameter of between 5 and 15 centimeters.

In addition to the fastening of the membrane 14, this upper bearing surface 16 also makes it possible to mount a wave guide 20, also fastened inside the box 30. This wave guide 20 has a substantially truncated pyramidal shape with a long front wall 21 and a short rear wall 22.

References to the relative terms "front" and "rear" should be understood relative to FIG. 2 in which the front part of the enclosure 10 is the part intended to be positioned close to the audience, while the rear part of the enclosure 10 is the part intended to be positioned furthest from the audience. Obviously, the loudspeaker 11 may be arranged differently without changing the invention but, in all cases, the long front wall 21 forms a front face Fa of the enclosure 10 with regard to the propagation of the sound waves.

It is sought to limit the propagation of the sound waves in the front part of the enclosure 10 in order to increase the crosstalk of the enclosure 10. The crosstalk is measured at the level of the audience, for example by a microphone 42, by means of the ratio Sr to Sd between the sound Sr picked up by the audience by reverberation, and the sound Sd picked up by the audience coming directly from the enclosure 10.

In the wave guide 20, the long wall 21 limits the propagation of the direct sound waves Sd to promote the reception by the audience of the sound waves Sr obtained by reverberation on the ceiling 41. The walls 21 and 22 of the wave guide 20 are connected by lateral uprights 23. The opening angle of the wave guide 20, i.e., the angle of inclination a2 of the various walls 21 to 23 of the wave guide 20 from the upper bearing surface 16 of the frame 12, is preferably between 5 and 10 degrees.

For a loudspeaker 11 whose upper bearing surface 16 is between 5 and 15 cm, the long front wall 21 may be between 12 and 20 cm long, preferably between 14 and 15 cm.

The short rear wall 22 may be between 0 and 5 cm long. Around the terminal end of the walls 21 to 23, i.e., at the end opposite to that fastened onto the upper bearing surface 16 of the frame 12, the wave guide 20 may have a flap intended to allow the fastening of the wave guide 20 onto the box 30.

The invention proposes to improve the wave guide 20 by integrating at least one acoustic wall 25, fastened between the lateral uprights 23. Thus, in the embodiment of FIG. 2, the enclosure 10 comprises a single acoustic wall 25 whereas, in the second embodiment of FIG. 3, the wave guide 20 integrates a second acoustic wall 26. This embodiment of FIG. 3 is also shown in perspective in FIGS. 7*a*-7*d*.

The first acoustic wall 25 is fastened between the lateral uprights 23. It may extend over the entire height of these lateral uprights 23 to form a substantially trapezoidal plate. Alternatively, the height of this acoustic wall 25 may extend over only part of the height of the vertical uprights 23.

Figure 4:
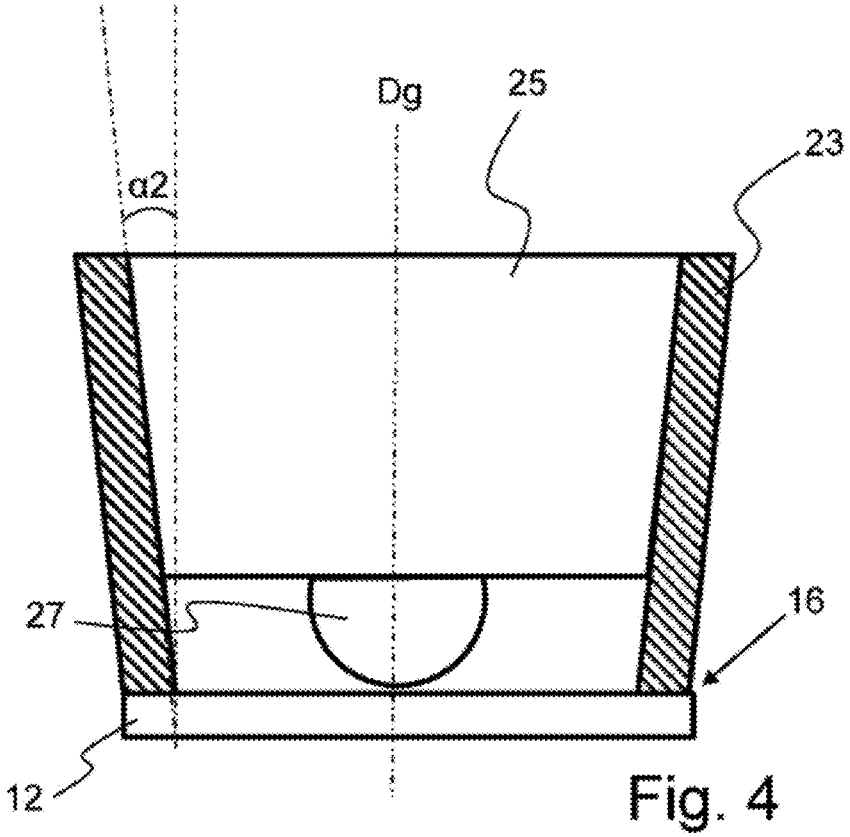
FIG. 4 is a schematic sectional view of the first acoustic wall of the wave guide of FIG. 3.
Figure 5:
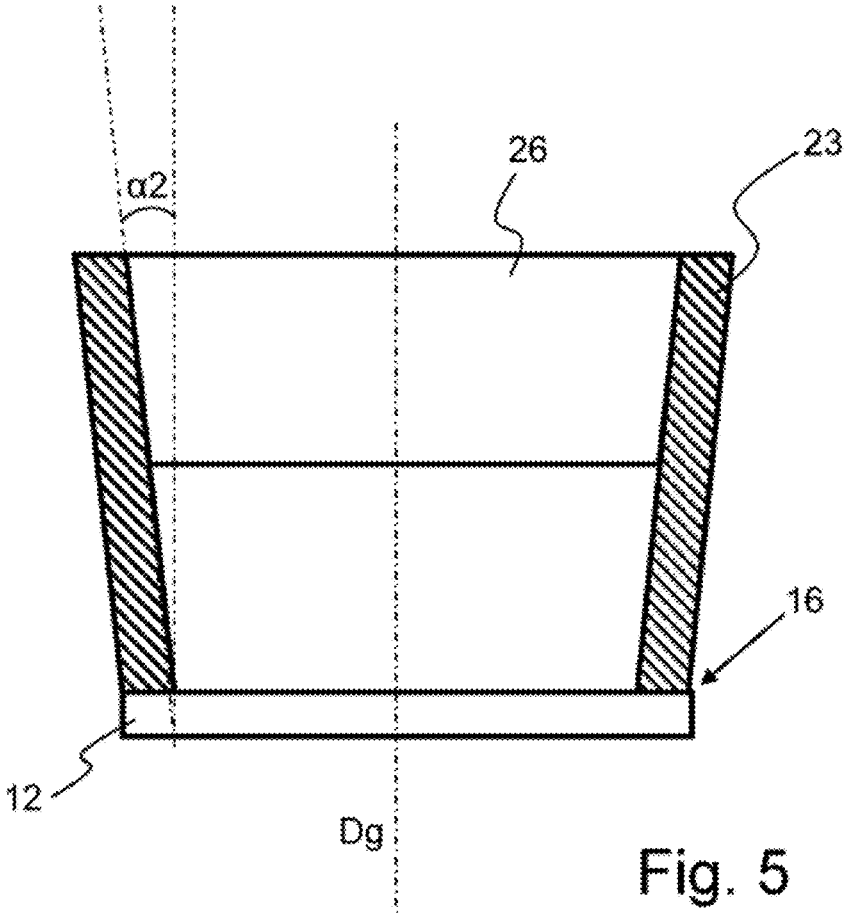
FIG. 5 is a schematic sectional view of the second acoustic wall of the wave guide of FIG. 3.

In addition, this first acoustic wall 25 extends substantially tangentially to a generatrix line Dg of the cylindrical support 13. Indeed, the cylindrical support 13 has an axis of revolution Ar around which a set of generatrix lines form the different points of the cylinder. Among all of these generatrix lines, the generatrix line Dg closest to the front face Fa constitutes the line on which the first acoustic wall is formed. Thus, as illustrated in FIG. 4, the line Dg passes substantially through the center of the trapezoidal shape of the first acoustic wall 25.

Preferably, the lower part of the first acoustic wall 25 is provided with a semi-circular lip 25, extending in the direction of the cylindrical support 13, and substantially at the center of the lateral uprights 23.

In the example of FIG. 3, a second acoustic wall 26 is also fastened between the two lateral uprights 23 over only part of the height of these lateral uprights 23, as shown in For example, the distance D1 between the first 25 and the second 26 acoustic wall is preferably substantially equal to the radius R of the cylindrical support 13. Thus, the second acoustic wall 26 extends along an axis A2 parallel to the axis of revolution Ar and to the generatrix line Dg.

Figure 6A:
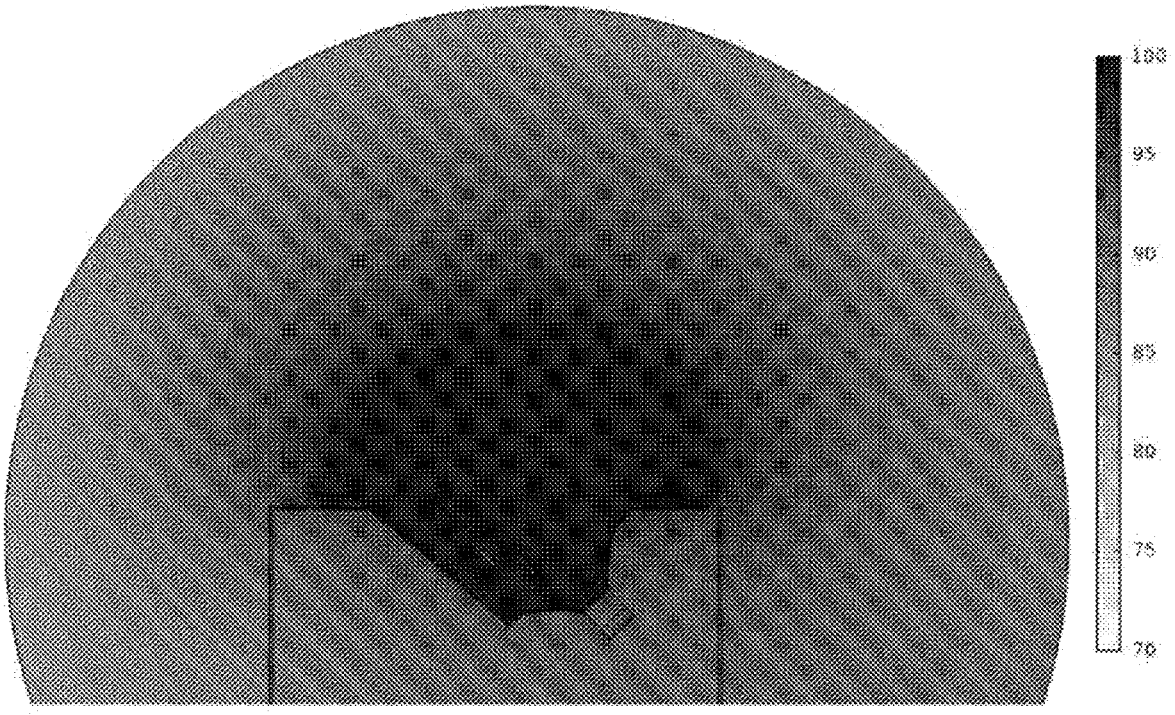
FIGS. 6*a*-6*f* are sectional views of the loudspeaker and wave guide of FIG. 3 for different frequencies generated by the loudspeaker: 100 Hz (FIG. 6*a*); 1 kHz (FIG. 6*b*); 2 kHz (FIG. 6*c*); 5 kHz (FIG. 6*d*); 10 kHz (FIG. 6*e*) and 16 kHz (FIG. 6*f*).

FIGS. 6*a*-6*f* show propagation simulations of the sound waves of FIG. 3 embodiment. As shown in FIG. 6*a*, the entire surface of the membrane 14 is used to generate the 100 Hz sound waves, and the front face Fa of the wave guide 20 is sufficient to guide the sound waves towards the ceiling 41.

Figure 6B:
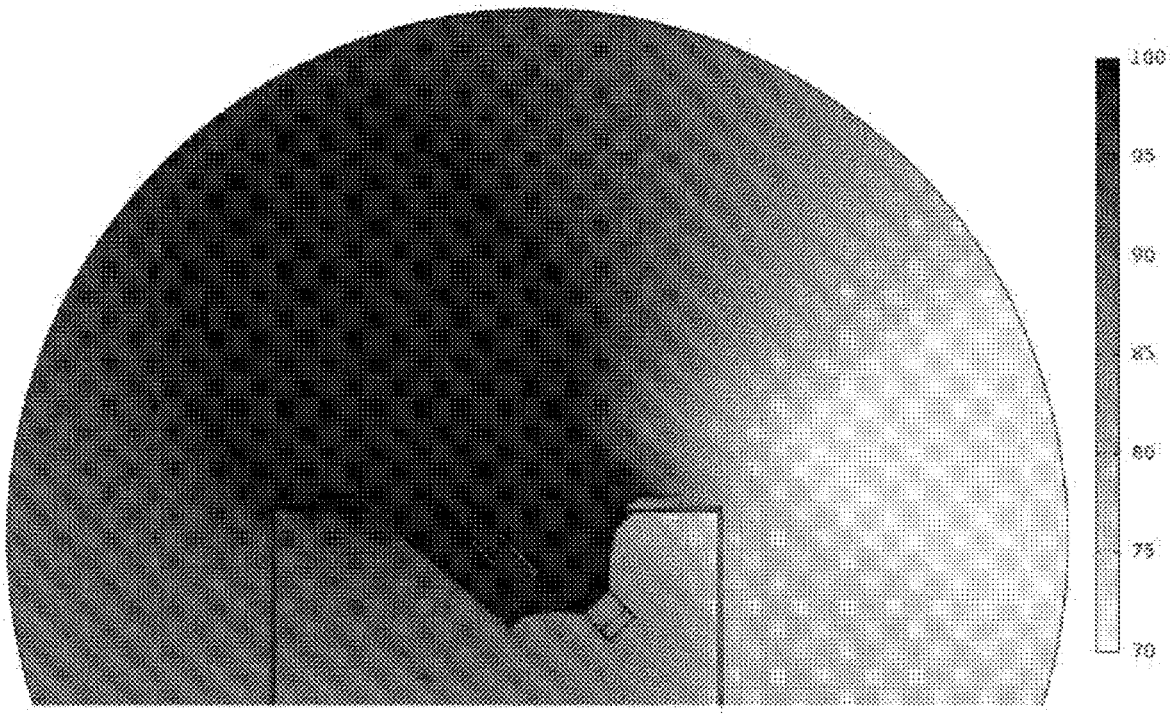

When the frequency of the sound waves increases, as illustrated in FIG. 6*b* for a frequency of 1 kHz, the sound waves tend to escape from the wave guide 20 through the front face Fa, and these sound waves risk creating disruption to the audience.

Figure 6C:
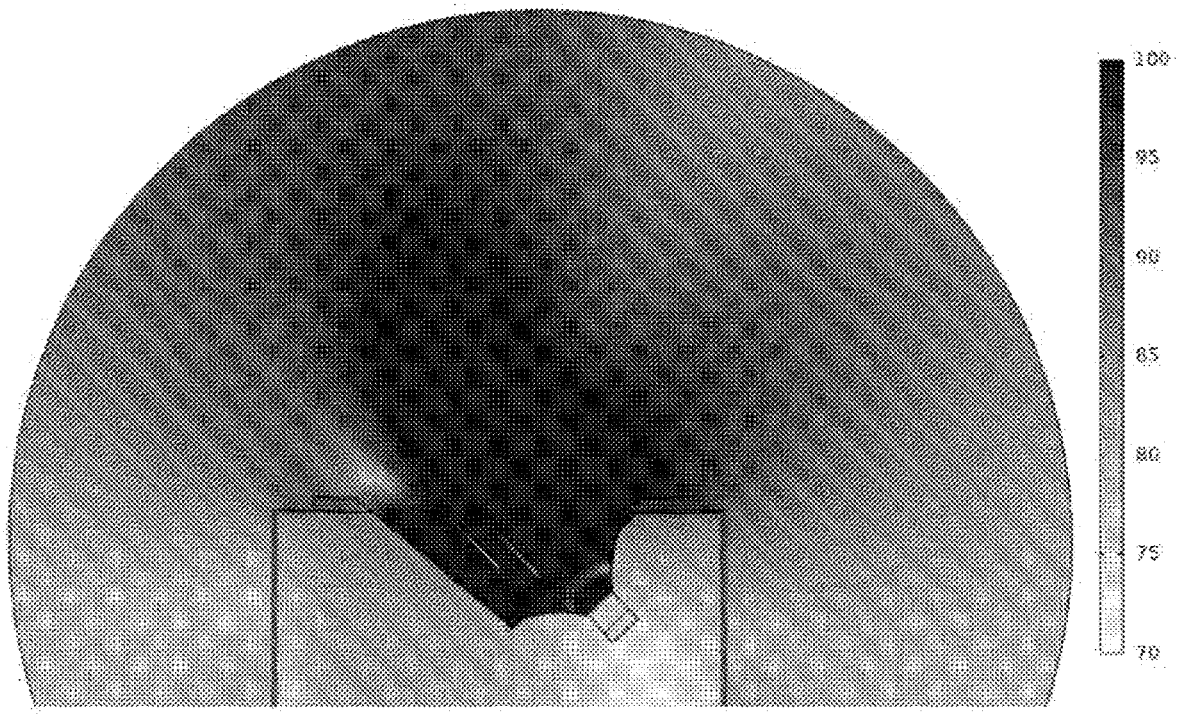

From the frequency of 2 kHz, as illustrated in FIG. 6*c*, the second acoustic wall 26 picks up part of the sound waves generated by the loudspeaker 11 to redirect them in the direction of the ceiling 41.

Figure 6D:
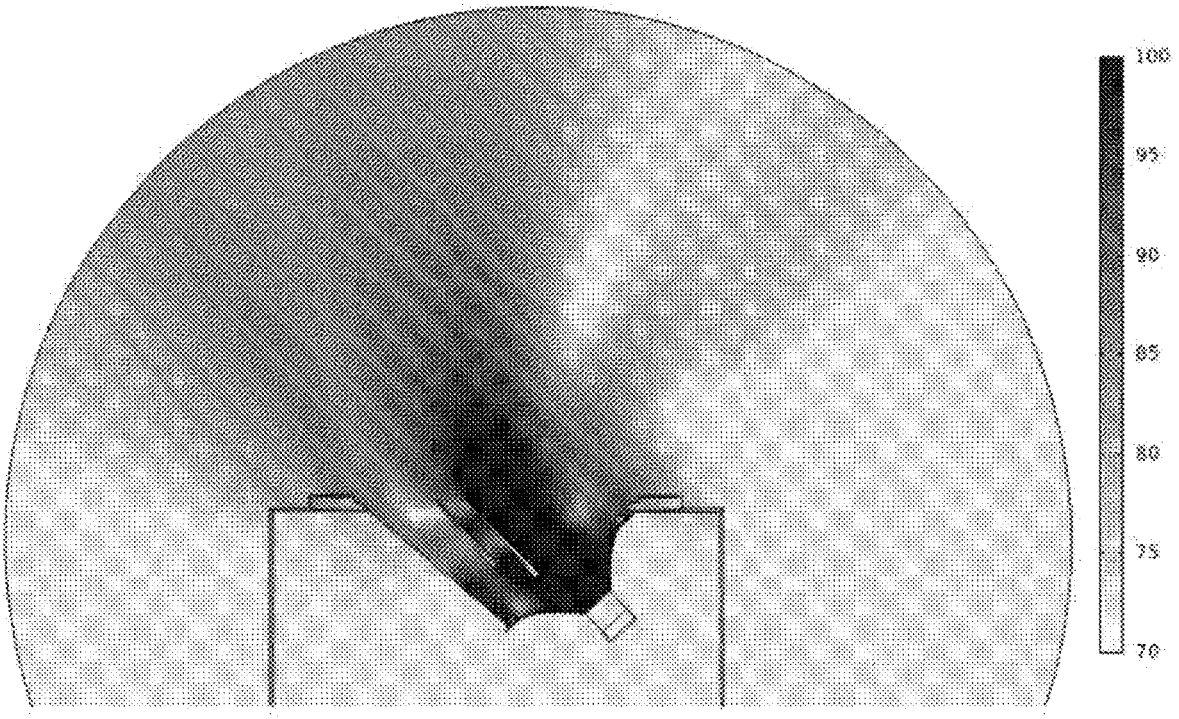

For even higher frequencies, such as the 5 kHz frequency illustrated in FIG. 6*d*, the generation of the sound waves is very localized in the center of the membrane 14. In this simulation, the second acoustic wall 26 becomes inoperative and it is the first acoustic wall 25 which makes it possible to guide the acoustic waves towards the ceiling 41.

Figure 6E:
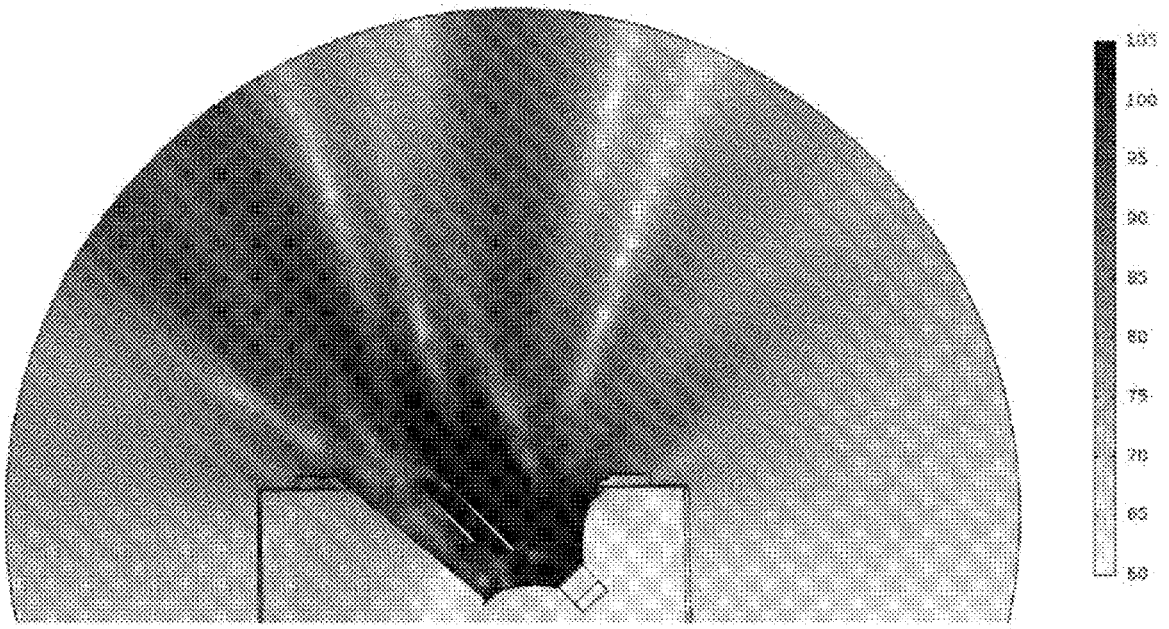
Figure 6F:
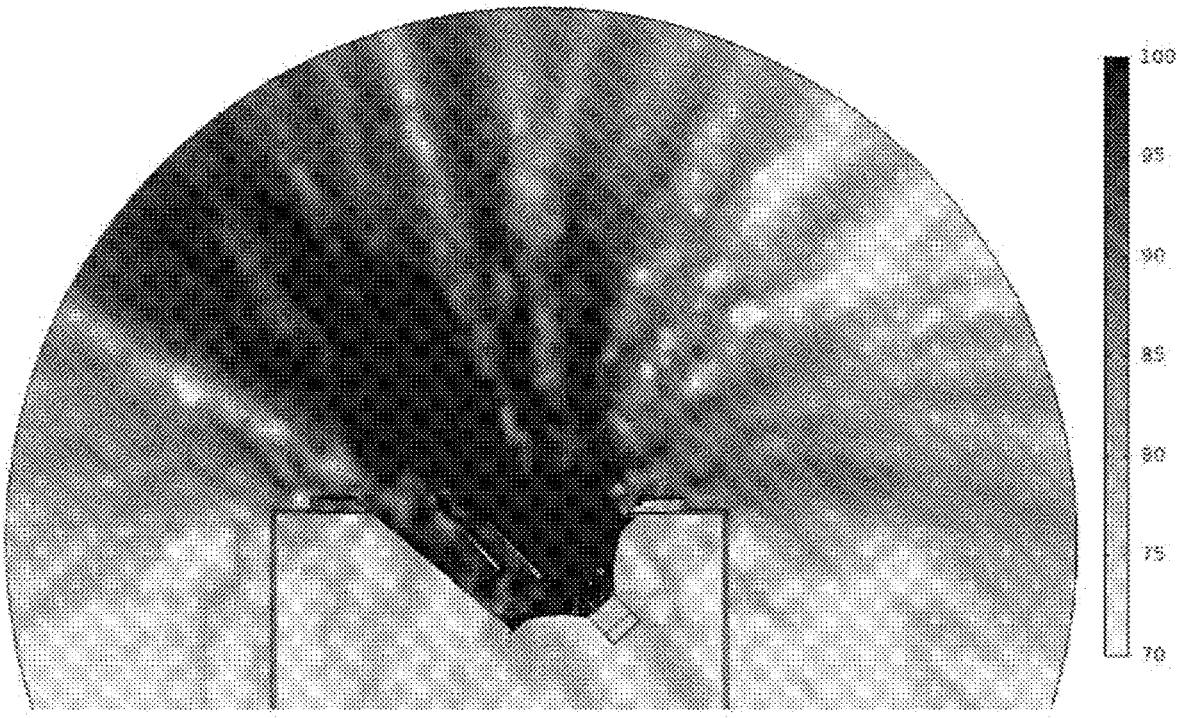
Figure 7A:
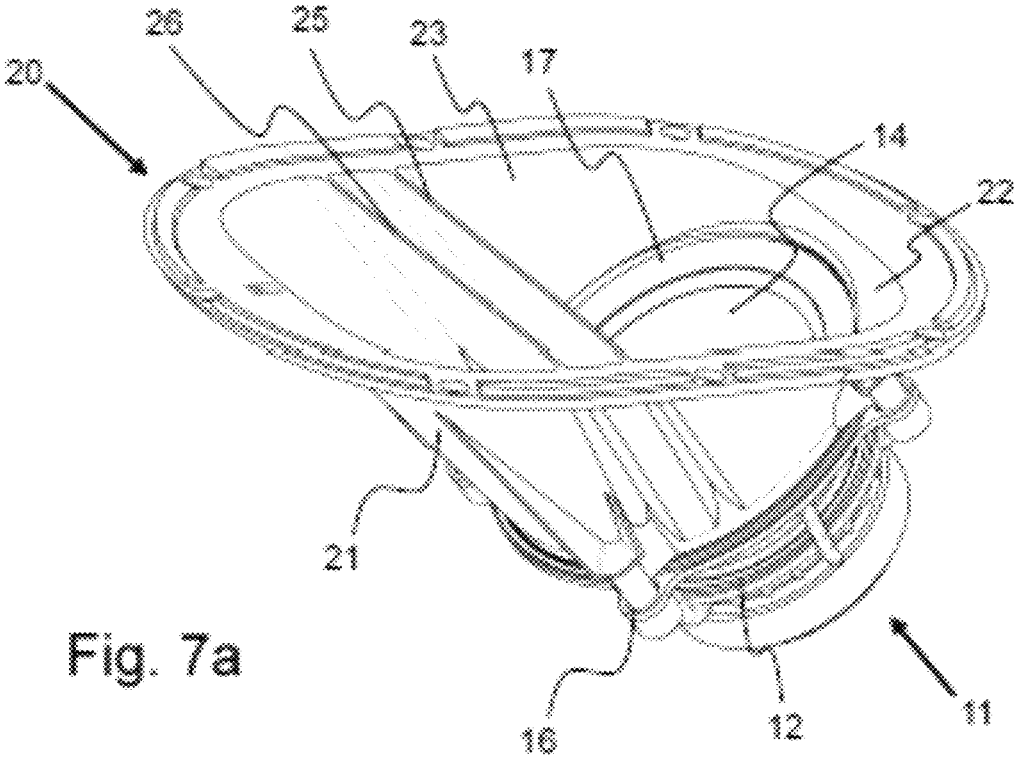
FIG. 7*a* is a first perspective view of the loudspeaker and wave guide of FIG. 3.
Figure 7B:
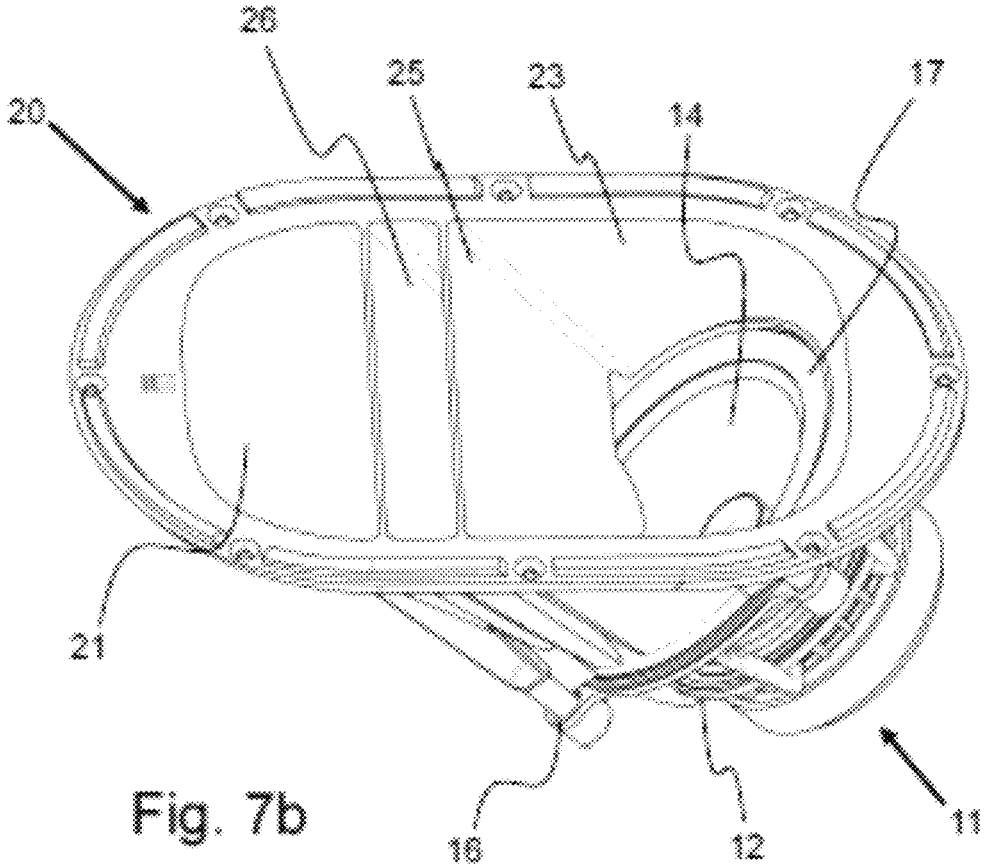
FIG. 7*b* is a second perspective view of the loudspeaker and wave guide of FIG. 3.
Figure 7C:
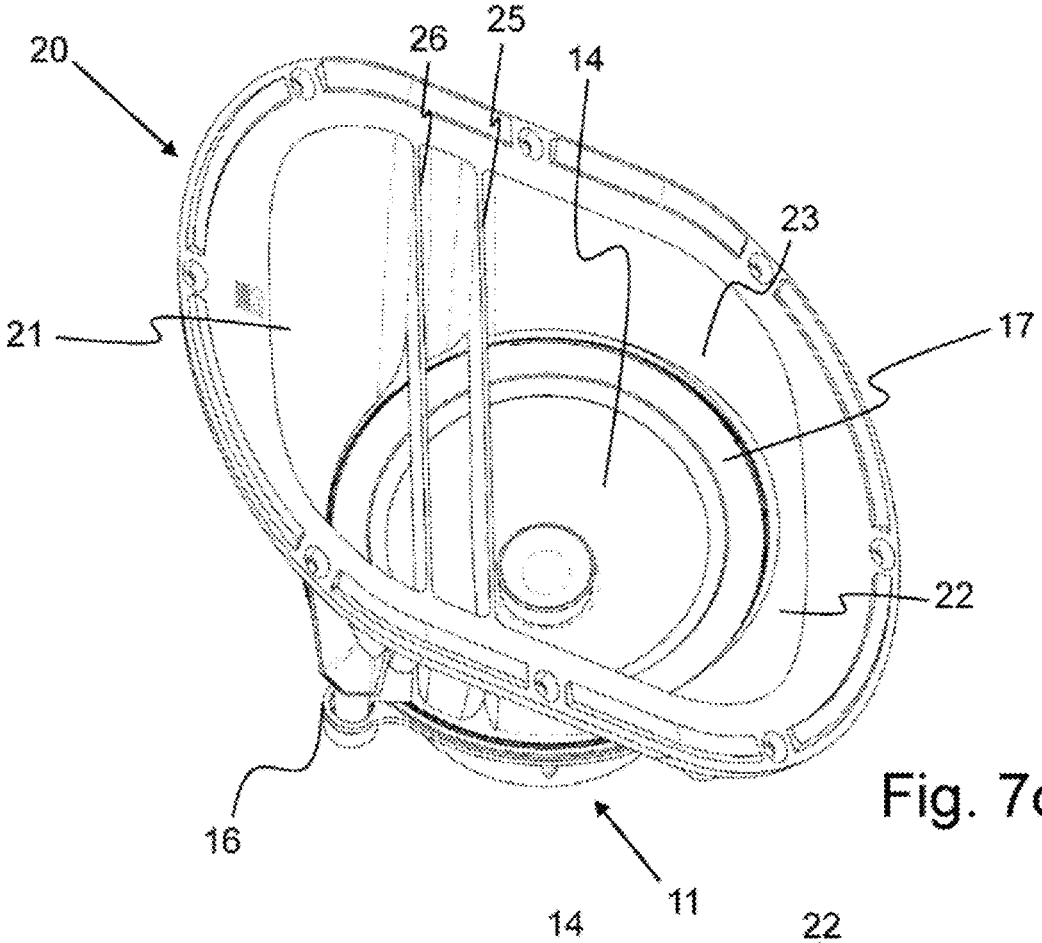
FIG. 7*c* is a third perspective view of the loudspeaker and wave guide of FIG. 3.
Figure 7D:
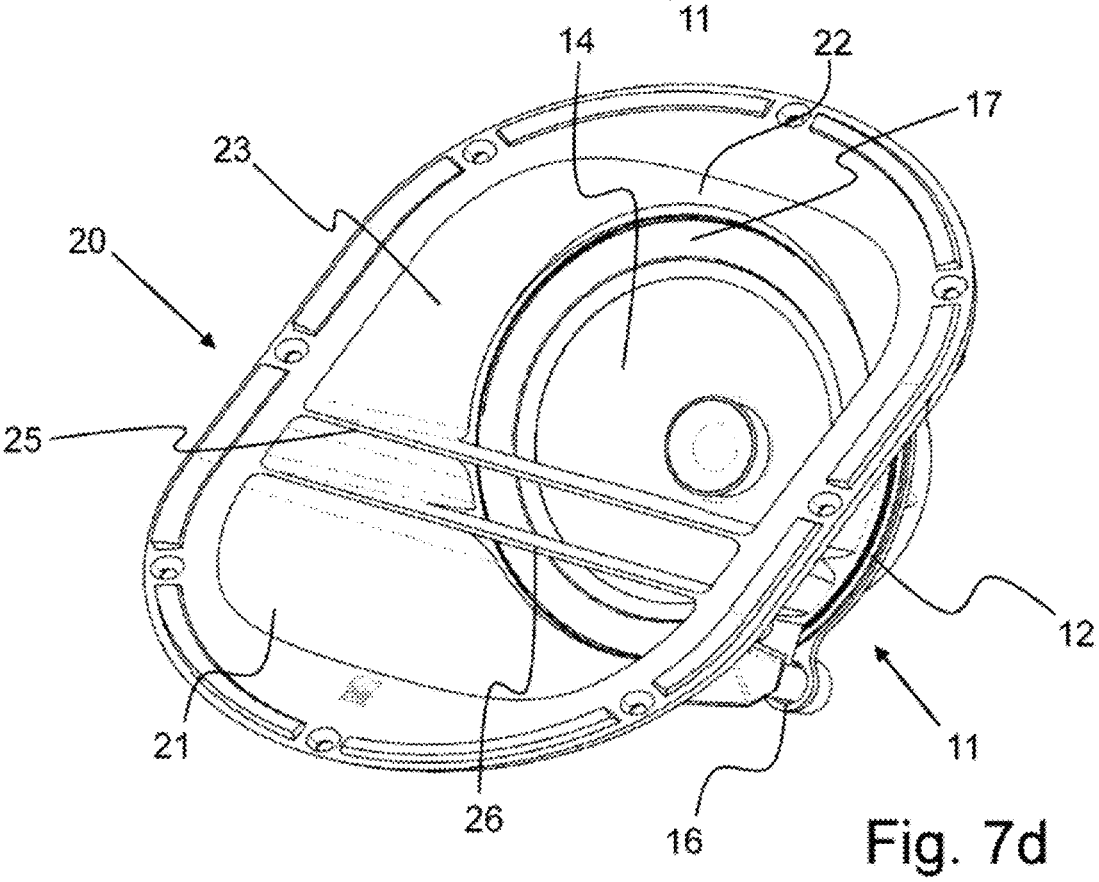
FIG. 7*d* is a fourth perspective view of the loudspeaker and wave guide of FIG. 3

Then, for larger frequencies, such as the 10 kHz frequency shown in FIG. 6*e* or the 16 kHz frequency shown in FIG. 6*f*, sound waves are generated from the level of the inverted dome of loudspeaker 11. For these frequencies, the semi-circular lip 27 of the first acoustic wall 25 makes it possible to channel the sound waves on the first acoustic wall 25 in order to transmit them in the direction of the ceiling 41.

In conclusion, in order to improve crosstalk, the invention proposes modifying a wave guide 20 of an enclosure 10 for diffusing sound by reverberation.

This improvement in crosstalk makes it possible to reduce the angle of inclination a1 of the loudspeaker 11 and, thus, to place the enclosure 10 farther from the audience in order to reduce the installation constraints of the enclosure 10. It follows that the invention makes it easier to create a home cinema or a music listening room.

The invention claimed is:

1. An enclosure for diffusing sound by reverberation comprising:

a loudspeaker comprising:

a fixed frame, a cylindrical support movable in translation, and a membrane whose annular outer edge is connected to an upper bearing surface of said frame by means of a suspension and an annular inner edge which is fastened onto said cylindrical support; and a wave guide mounted on said upper bearing surface of said frame, said wave guide being substantially in the shape of a truncated pyramid with a long wall, a short wall and lateral uprights connecting said walls;

wherein said long wall forms a front face of said enclosure such that said long wall blocks the propagation of sound in front of said enclosure so that the greater part of the sound is directed towards a reflective surface;

wherein said wave guide also comprises at least one acoustic wall fastened onto said lateral uprights, said acoustic wall extending tangentially relative to the generatrix line of said cylindrical support closest to said front face.

2. The enclosure for diffusing sound by reverberation according to claim 1, wherein said wave guide also comprises a second acoustic wall fastened between said lateral uprights and between said first acoustic wall extending tangentially relative to the generatrix line and said front face, said second acoustic wall extending substantially parallel to said first acoustic wall, a distance between said acoustic walls being substantially equal to the radius of said cylindrical support.

3. The enclosure for diffusing sound by reverberation according to claim 1, wherein said acoustic wall extending tangentially relative to the generatrix line comprises a semi-circular lip extending in direction of said cylindrical support substantially at the center of said lateral uprights.

4. The enclosure for diffusing sound by reverberation according to claim 1, wherein said enclosure comprises a box onto which said loudspeaker and said wave guide are integrated, said box having a height less than 14 cm, a length less than 28 cm and a width less than 18 CM.

5. The enclosure for diffusing sound by reverberation according to claim 4, wherein said loudspeaker is inclined at an angle of between 40 and 60° relative to a length of said box.

6. The enclosure for diffusing sound by reverberation according to claim 1, wherein an upper surface of said cylindrical support is provided with a dome.

7. The enclosure for diffusing sound by reverberation according to claim 6, wherein said dome is inverted.

8. The enclosure for diffusing sound by reverberation according to claim 1, wherein said loudspeaker has a membrane whose diameter is between 5 and 15 cm.

9. A home cinema installation comprising an enclosure for diffusing sound by reverberation said enclosure comprising:

a loudspeaker comprising: a fixed frame, a cylindrical support movable in translation, and a membrane whose annular outer edge is connected to an upper bearing surface of said frame by means of a suspension and an annular inner edge which is fastened onto said cylindrical support; and a wave guide mounted on said upper bearing surface of said frame, said wave guide being substantially in the shape of a truncated pyramid with a long wall, a short wall and lateral uprights connecting said walls;

wherein said long wall forms a front face of said enclosure such that said long wall blocks the propagation of sound in front of said enclosure so that the greater part of the sound is directed towards a reflective surface; and wherein said wave guide also comprises at least one acoustic wall fastened onto said lateral uprights, said acoustic wall extending tangentially relative to the generatrix line of said cylindrical support closest to said front face.

* * * * *